United States Patent [19]

Matsuo et al.

[11] 4,324,702

[45] Apr. 13, 1982

[54] OXIDE THERMISTOR COMPOSITIONS

[75] Inventors: Yoshihiro Matsuo, Neyagawa; Takuoki Hata, Sakai; Takayuki Kuroda, Nishinomiya, all of Japan

[73] Assignee: Matsushita Electric Industrial Co., Ltd., Kadoma, Japan

[21] Appl. No.: 201,441

[22] Filed: Oct. 28, 1980

[30] Foreign Application Priority Data

| | | | |
|---|---|---|---|
| Nov. 2, 1979 | [JP] | Japan | 54-142233 |
| Nov. 2, 1979 | [JP] | Japan | 54-142239 |
| Nov. 10, 1979 | [JP] | Japan | 54-145840 |
| Dec. 14, 1979 | [JP] | Japan | 54-162949 |
| Dec. 14, 1979 | [JP] | Japan | 54-162950 |
| Jan. 18, 1980 | [JP] | Japan | 55-4905 |

[51] Int. Cl.[3] ..... H01B 1/06

[52] U.S. Cl. ..... 252/519; 252/518; 252/520; 338/22 R

[58] Field of Search ..... 252/518, 519, 520, 521, 252/512; 338/22 R; 106/47 R, 52

[56] References Cited

U.S. PATENT DOCUMENTS

| | | | |
|---|---|---|---|
| 3,444,501 | 5/1969 | Delaney et al. | 252/519 |
| 3,510,820 | 5/1970 | Jonker et al. | 252/519 |
| 3,652,463 | 3/1972 | Riddel | 252/519 |
| 3,913,057 | 10/1975 | Ushida et al. | 252/521 |
| 3,958,209 | 5/1976 | Soda et al. | 252/520 |
| 3,960,778 | 6/1976 | Bouchard et al. | 252/519 |
| 3,962,145 | 6/1976 | Matsuo et al. | 252/519 |
| 4,041,436 | 8/1977 | Kouchich et al. | 252/519 |

OTHER PUBLICATIONS

Mn-Co Oxide Systems (Hatachi Central Lab. Tech. Papers, Memorial Edition), 1962.

Mn-Ni-Co-Oxide Systems (Denki Kagaku), vol. 19, No. 9, 1951.

*Primary Examiner*—Joseph L. Schofer

*Assistant Examiner*—J. L. Barr

*Attorney, Agent, or Firm*—Stevens, Davis, Miller & Mosher

[57] ABSTRACT

Oxide thermistor compositions which comprise 100 atomic % of at least four kinds of cations which are (1) Mn ion, (2) Ni ion, (3) at least one kind of ion selected from the group consisting of Cu, Fe, and Cr, and (4) one kind of ion selected from the group consisting of Cr, Zr, and Li. These compositions have lower resistivity with higher B-constant and exhibit a high stability of resistance.

5 Claims, No Drawings

OXIDE THERMISTOR COMPOSITIONS

The present invention relates to oxide compositions for thermistors.

Thermistors containing primarily Mn-oxide and additionally Co-oxide have been widely used until now. The reasons why the thermistors of Co-oxide-containing composition have been widely used are due to the excellent thermistor properties thereof such as (1) higher B-constant (which can be obtained) together with low resistivity and (2) a smaller resistance (duration in load aging in the temperature below 300° C. under an application of a d.c. voltage.) Thermistor materials having decreased resistivity have as a rule decreased B-constant. Accordingly, it can be said that a material having a low resistivity together with a higher B-constant is useful as a thermistor.

However, Co-oxide sources have recently become difficult to obtain and more expensive throughout the world, and this has developed a need for a thermistor composition containing no Co-oxide, which also exhibits excellent thermistor properties comparable to those of Co-oxide-containing thermistor compositions.

An object of the present invention is to provide oxide thermistor compositions containing no Co-oxide.

Another object of the present invention is to provide oxide compositions for thermistors having high stable electrical characteristics in load aging under an application of a d.c. voltage.

A further object of the present invention is to provide oxide compositions for thermistors having lower resistivity with higher B-constant.

The oxide thermistor compositions of the present invention are characterized by containing primarily Mn-oxide and additionally Ni-oxide, at least one kind of oxide selected from the group consisting of Cu-oxide, Fe-oxide, and Zr-oxide, and one kind of oxide selected from the group consisting of Cr-oxide, Zr-oxide, and Li-oxide.

The effect of Cr-oxide contained in the compositions of the present invention is to provide a high stability of resistivity; the effect of Zr-oxide therein is to provide a relative stability of resistivity and also relatively high B-constant; and the effect of Li-oxide therein is to provide a B-constant relatively high for the resulting low resistivity.

Referring to the prior art of the thermistor compositions which contain primarily Mn-oxide and additionally Cr-oxide, only the following systems have been disclosed:

Mn-Cr oxide systems (Hitachi Central Lab. Tech. Papers, the Memorial Edition for the 20th Anniversary of the Establishment, 1962).

Mn-Ni-Cr oxide systems [Denki Kagaku, Vol. 19, No. 9, (1951)]

Mn—Cu—Cr oxide systems
Mn—Cu—Fe—Cr oxide systems } [J. Phys. Chem. Solid, (1972), Vol. 33, pp. 737-747.]

Type of oxide thermistor compositions of the present invention includes
Mn-Ni-Cu-Cr oxides,
Mn-Ni-Fe-Cr oxides, and
Mn-Ni-Cu-Fe-Cr oxides.

These compositions are based upon the finding of the fact, as an effect of the contained chromium which is a feature of the present compositions, that the percentage of resistance deviation thereof in the lapse of 3000 hours in load aging under an application of a d.c. voltage of 10 V/mm at the temperature of 150° C. is as small as ±2%, in other words, upon the finding that Cr-oxide has such an effect to stabilize electrical characteristics of thermistors.

Referring to the prior art of thermistor compositions which contain primarily Mn-oxide and additionally Zr-oxide, only one example, i.e., Mn-Zr oxide systems (Hitachi Central Lab. Tech. Papers, the Memorial Edition for the 20th Anniversary of the Establishment, 1962) has been disclosed.

Type of oxide thermistor compositions of the present invention includes
Mn-Ni-Cu-Zr oxides,
Mn-Ni-Fe-Zr oxides,
Mn-Ni-Cr-Zr oxides, and
Mn-Ni-Fe-Cr-Zr oxides.

These compositions are based upon the finding of an effect of the contained Zr, which is a feature of the this type of the composition of the present invention, giving relatively stable electrical characteristics and a B-constant relatively high for the resulting low resistivity.

Referring to the prior art of the thermistor compositions which contain primarily Mn-oxide and additionally Li-oxide, only the following systems have been disclosed:

Mn-Li oxide, Mn-Ni-Li oxide, Mn-Cu-Li oxide and Mn-Fe-Li oxide systems (Hitachi Central Lab. Tech. Papers, the Memorial Edition for the 20th Anniversary of the Establishment, 1962).

Type of oxide thermistor compositions of the present invention includes
Mn-Ni-Cu-Li oxides,
Mn-Ni-Fe-Li oxides, and
Mn-Ni-Cu-Fe-Li oxides.

These compositions are based upon the finding of an effect of the contained Li, which is a feature of this type of the composition of the present invention, giving a B-constant relatively high for the resulting low resistivity.

DETAILED DESCRIPTION OF THE INVENTION

The thermistor compositions of the present invention which are characterized by containing chromium comprise as cations 94.6–30 atomic % of Mn ion, 5–30 atomic % of Ni ion, 0.1–15 atomic % of Cu ion, and 0.3–40 atomic % of Cr ion, the total amount of said cations being 100 atomic %. In this place, a Cr content less than 0.3 atomic % has no observable high stability of resistivity in load aging at the temperature of 150° C. under an application of a d.c. voltage. The Cr content range wherein this effect is remarkable is from 3 to 30 atomic %. A Cr content exceeding 40 atomic % gives a high resistivity coupled with a high B-constant, which is undesirable because it departs from the range of the electrical characteristic values required for practical use. The reason for limiting each content of Mn, Ni, and Cu is based on the electrical characteristic values of the existing general purpose NTC thermistors commercially available, that is to say, the limitation is intended to secure a practical resistivity at 25° C. staying within the range of 10 Ωcm to 1 M Ωcm and also a B-constant staying within the range of 1000° K. to 6000° K. With electrical characteristic values out of these ranges, the compositions are deficient in practical usefulness. The resistivity of a thermistor of this type at 25° C. ($\rho$25° C.) decreases with an increase in Ni-to-Mn ratio, reaching a minimum at a Ni content of 22 atomic %, and then over this point it conversely begins to rise with the Ni content. On the other hand, the B-constant only decreases a little with an increase in the Ni content, exhibiting a somewhat vague peak at a Ni content of 17.5 atomic % (corresponding to phase transition). In addition, the $\rho$25° C. and B-constant both decrease when the Cu content is raised versus the Mn content. As a result, the $\rho$25° C. of a composition having a Ni content smaller than 5 atomic % with a Cu content smaller than 0.1 atomic % is out of the range of resistivity acceptable for practical use. Moreover, a Ni content over 30 atomic % is undesirable for thermistor materials because it gives an increased $\rho$25° C. together with a decreased B-constant. A Cu content over 15 atomic % is also undesirable for practical thermistors because it gives the markedly decreased values of both $\rho$25° C. and B-constant.

Secondly, referring to the Mn-Ni-Fe-Cr oxide and Mn-Ni-Cu-Fe-Cr oxide compositions, there is an observable high stability of resistivity in the load aging similar to that in the above Mn-Ni-Cu-Cr oxide compositions. However, the $\rho$25° C. is rather low in comparison with the case of the Mn-Ni-Cu-Cr oxide compositions.

The thermistor compositions of the present invention, which are characterized by containing zirconium, comprise as cations 94.6–50 atomic % of Mn ion, 5–25 atomic % of Ni ion, 0.1–5 atomic % of Cu ion, and 0.3–20 atomic % of Zr ion, the total amount of said cations being 100 atomic %. In this place, a Zr content smaller than 0.3 atomic % has no observable effect of giving a B-constant relatively high for the resulting low resistivity. The Zr content range wherein this effect is remarkable is from 0.5 to 10 atomic %. A Zr content over 15 atomic % results in electrical characteristics of a B-constant relatively low for the resulting high resistivity. With a Ni content smaller than 5 atomic % together with a Cu content smaller than 0.5 atomic %, the $\rho$25° C. is much higher, departing from the range of resistivity appreciable for practical use. A Ni content over 25 atomic % is also undesirable because it gives an increased $\rho$25° C. value and in addition a decreased B-constant. Further, a Cu content over 5 atomic % is undesirable for thermistors for practical use, because it markedly reduces both $\rho$25° C. and B-constant.

The further thermistor compositions of the present invention which are characterized by containing zirconium comprise as cations 94.6–50 atomic % of Mn ion, 5–25 atomic % of Ni ion, 0.15–5 atomic % of Cu ion, and 0.3–20 atomic % of Zr ion, the total amount of said cations being 100 atomic %. In this place, a Zr content smaller than 0.3 atomic % has no observable effect of giving a B-constant relatively high for the resulting low resistivity. A Zr content over 10 atomic % gives characteristics of high resistivity with high B-constant, which is undesirable because of departing from the range of the electrical characteristic values required for practical use. A total content of Fe and/or Cr of smaller than 0.3 atomic % has no high stability of resistivity in load aging at the temperature of 150° C. under an application of a d.c. voltage. A total content of Fe and/or Cr of larger than 5 atomic % is undesirable because it gives a high resistivity which is out of the range of the characteristic values required for practical use. More unfavorably, such a content reduces the sintering capability.

The thermistor compositions of the present invention which are characterized by containing lithium comprise as cations 94.8–50 atomic % of Mn ion, 5–25 atomic % of Ni ion, 0.1–5 atomic % of Cu ion, and 0.1–20 atomic % of Li ion, the total content of said cations being 100 atomic %. In this place, a Li content smaller than 0.1 atomic % has no effect of giving the characteristics of a B-constant relatively high for the resulting low resistivity. The Li content range wherein this effect is remarkable is from 1 to 15 atomic %. A Li content over 20 atomic % results in characteristics of high resistivity with high B-constant, in other words, this is undesirable for the purpose of the present thermistor compositions since only the resistivity shows an increased value while the B-constant shows practically no increased value. With a Ni content smaller than 5 atomic % together with a Cu content smaller than 0.1 atomic %, the $\rho$25° C. is much higher, departing from the range of the proper resistivity for practical use. A Ni content over 25 atomic % is also undesirable for the purpose of the present thermistor compositions, because it gives an increased resistivity with a decreased B-constant. With a Cu content over 5 atomic %, it gives markedly decreased values of both $\rho$25° C. and B-constant, which are undesirable as characteristics of thermistors for practical use.

In the Mn-Ni-Fe-Li oxide compositions, there is also observed the effect of the added lithium, i.e., characteristics featured by a B-constant relatively high for the low resistivity. An only difference from the Mn-Ni-Cu-Li oxide compositions is that the level of the $\rho$25° C. of these compositions is about one order higher than that of the above compositions. In the Mn-Ni-Cu-Fe-Li oxide compositions, however, the $\rho$25° C. is observed to be rather small as compared with the case of the Mn-Ni-Cu-Li oxide compositions, when the total content of Cu and Fe does not exceed 5 atomic %. In these Mn-Ni-Cu-Fe-Li oxide compositions, there is equally observed the effect of the added lithium, i.e., the characteristics featured by a B-constant relatively high for the resulting low resistivity.

The commercial powdered compounds, $MnCO_3$, NiO, CuO, $Fe_2O_3$, $Cr_2O_3$, $ZrO_2$, and $Li_2CO_3$, were blended as the raw materials to give each of the compositions represented by atomic % in Tables 1, 2, and 3. To illustrate the process for preparing thermistors, the blended composition was wet mixed in a ball mill; the resulting slurry was dried, and then calcined at 800° C.; the calcined material was wet mixed and ground in a ball mill; the resulting slurry was dried and polyvinyl alcohol was admixed therewith as a binder; therefrom a number of the required amount of the mass were taken and each was pressed to form a disk; these disks were sintered in the air at 1100° C. (the sintering temperature for producing practical thermistors can be varied within the range of 1000°–1200° C.) for 2 hours; each of two electrodes comprising silver as main constituent was baked on each side surface of the sintered disk (about 7 mm in diameter and 1.5 mm in thickness) to obtain ohmic contact. The resistance was measured on these specimens at 25° and 50° C. ($R_{25°}$ C. and $R_{50°}$ C.), and therefrom the resistivity at 25° C. ($\rho$25° C.) and the B-constant were calculated using the following formulae (1) and (2), respectively:

$$\rho\ 25^\circ\ C. = R_{25^\circ C.} \times \frac{S}{d} \quad (1)$$

(S: surface area of either of the electrodes; d: distance between the two electrodes)

$$B = 8.868 \times 10^3 \times \log \frac{R_{25^\circ C.}}{R_{50^\circ C.}} \quad (2)$$

In order to evaluate the stability of resistance of each specimen, a d.c. voltage of 10 V/mm was applied to each specimen in a thermostat of 150° C. to measure the resistance deviation with time during 3000 hours. These results were shown in Tables, 1, 2, and 3.

TABLE 1

| Sample No. | Composition of sample (atomic % of constituent) Mn | Ni | Cu | Fe | Cr | ρ25° C. [Ω . cm] | B [K] | Percentage of resistance with time (%) |
|---|---|---|---|---|---|---|---|---|
| 101* | 80 | 17.5 | 2.5 | 0 | 0 | 820 | 3900 | +3.8 |
| 102* | 79.9 | 17.5 | 2.5 | 0 | 0.1 | 800 | 3900 | +3.3 |
| 103 | 79.8 | 17.4 | 2.5 | 0 | 0.03 | 800 | 3900 | +1.8 |
| 104 | 79.2 | 17.3 | 2.5 | 0 | 1.0 | 870 | 3950 | +1.3 |
| 105 | 77.6 | 17.0 | 2.4 | 0 | 3.0 | 900 | 4000 | +0.7 |
| 106 | 72.0 | 15.8 | 2.2 | 0 | 10 | 1250 | 4100 | ±0.2 |
| 107 | 64.0 | 14.0 | 2.0 | 0 | 20 | 2400 | 4300 | ±0.2 |
| 108 | 48.0 | 10.5 | 1.5 | 0 | 40 | $8.3 \times 10^4$ | 5300 | ±0.2 |
| 109* | 40.0 | 8.8 | 1.2 | 0 | 50 | $2.1 \times 10^4$ | 6200 | −0.5 |
| 121* | 94.9 | 5.0 | 0.1 | 0 | 0 | $1.4 \times 10^4$ | 4800 | +3.5 |
| 122 | 94.6 | 5.0 | 0.1 | 0 | 0.3 | $9.0 \times 10^4$ | 4800 | +1.7 |
| 123* | 50 | 33 | 17 | 0 | 0 | 4.5 | 1300 | +2.2 |
| 124 | 45 | 30 | 15 | 0 | 10 | 120 | 2900 | +0.8 |
| 124 | 30 | 20 | 10 | 0 | 40 | $2.0 \times 10^4$ | 3900 | +0.5 |
| 125* | 20 | 35 | 5 | 0 | 40 | $1.3 \times 10^4$ | 5400 | ±0.2 |
| 201* | 80 | 17.5 | 0 | 2.5 | 0 | 3200 | 4000 | +4.5 |
| 202 | 79.8 | 17.4 | 0 | 2.5 | 0.3 | 3100 | 4000 | +1.9 |
| 203 | 77.6 | 17.0 | 0 | 2.4 | 3 | 5300 | 4100 | +1.3 |
| 204 | 72.0 | 15.8 | 0 | 2.2 | 10 | $1.1 \times 10^4$ | 4400 | +1.0 |
| 205 | 48.0 | 10.5 | 0 | 1.5 | 40 | $6.4 \times 10^5$ | 4900 | +0.9 |
| 206* | 40.0 | 8.8 | 0 | 1.2 | 50 | $7.3 \times 10^4$ | 5400 | +1.0 |
| 211 | 65.0 | 20.0 | 0 | 5.0 | 10 | $2.3 \times 10^4$ | 4300 | +1.2 |
| 212 | 55 | 25 | 0 | 10 | 10 | $4.1 \times 10^5$ | 4700 | +1.1 |
| 213* | 20 | 40 | 0 | 20 | 20 | $1.5 \times 10^4$ | 5100 | +1.3 |
| 301* | 74 | 20 | 5.0 | 1.0 | 0 | 130 | 3100 | +3.9 |
| 302 | 73.8 | 19.9 | 5.0 | 1.0 | 0.3 | 120 | 3100 | +1.8 |
| 303 | 66.6 | 18.0 | 4.5 | 0.9 | 10 | 630 | 3500 | ±0.2 |
| 304 | 44.4 | 12.0 | 3.0 | 0.6 | 40 | $5.4 \times 10^4$ | 4800 | ±0.2 |
| 305* | 37.0 | 10.0 | 2.5 | 0.5 | 50 | $1.4 \times 10^4$ | 6000 | ±0.2 |
| 311 | 62.0 | 20.0 | 7.0 | 1.0 | 10 | 400 | 3300 | +0.5 |
| 312 | 60.0 | 20.0 | 7.0 | 3.0 | 10 | 350 | 3100 | +0.9 |
| 313 | 56.0 | 20.0 | 7.0 | 7.0 | 10 | 210 | 3000 | +1.8 |

*The star mark represents a referential sample for comparison, which is out of the scope of the present invention.

Samples 109, 121, 125, 206, 213,and 305 have exhibited ρ25° C. values in excess of 1 M Ωcm and therefore are deficient in practical usefulness, departing from the scope of the present invention. Sample 123 has a ρ25° C. value lower than 10 Ωcm, which lies out of the range of proper resistivity for practical use. Samples 101, 102, 121, 123, 201, and 301 were regarded as being out of the scope of this invention because there was no indication of receiving the effect of the added chromium, which is an object of this invention, i.e., the objective effect is that the percentage of the resistivity deviation after 3000 hours' load aging under the above-mentioned conditions is not more than ±2%. All the samples that are within the scope of this invention have thermistor properties lying within the range of the electrical characteristic values required for practical use, and on all these samples the effect of the added chromium, i.e., resistance-stabilizing effect has been observed. This indicates that these samples can be put to practical use with satisfaction.

In the preparation of the above samples, agate balls were used for mixing the raw materials and for mixing and grinding the calcined materials. The results of elementary analysis on the above samples (sintered mass) showed that in every sample the total content of the contaminating, glass forming elements such as silicon and boron was not more than 1 atomic % per 100 atomic % of the thermistor constituting elements. Subsequently, the composition of sample 106 was selected out, blended with powdered silica to give Si contents of 1 and 2 atomic % per 100 atomic % of the thermistor-constituting elements, and processed in the same way and under the same conditions as used in preparing the above samples, to prepare two kinds of thermistor samples. As a result, the thermistor containing 1 atomic % of Si showed a ρ25° C. value of 1320 Ωcm, a B-constant of 4100° K., and a percentage of the abovementioned time-dependent resistance deviation of +0.5%, which are almost the same as those of sample 106, whereas the thermistor containing 2 atomic % of Si showed a ρ25° C. value of 2700 Ωcm, a B-constant of 4200° K., and a percentage of the time-dependent resistance deviation of +1.2%. The latter sample, in comparison with sample 106, has a ρ25° C. much higher (roughly twice) and a higher percentage of the time-dependent resistance deviation, which are undesirable for the objective thermistors of the present invention.

As mentioned above, this invention provides highly stable thermistor compositions, exhibiting extremely small percentages of the resistance deviation in load aging at the temperature of 150° C. under an application of a d.c. voltage.

TABLE 2

| Sample No. | Composition of sample (atomic %) Mn | Ni | Cu | Zr | ρ25° C. (Ω cm) | B (°K) |
|---|---|---|---|---|---|---|
| 1101* | 80 | 17.5 | 2.5 | 0 | 820 | 3900 |
| 1151 | 79.8 | 17.5 | 2.5 | 0.3 | 825 | 3880 |
| 1152 | 79.5 | 17.5 | 2.5 | 0.5 | 810 | 3940 |
| 1153 | 77.3 | 17.2 | 2.5 | 3.0 | 822 | 3970 |
| 1154 | 72.0 | 15.5 | 2.5 | 10.0 | 840 | 4030 |
| 1155 | 68.0 | 14.5 | 2.5 | 15.0 | 1880 | 3680 |
| 1156 | 65.0 | 12.5 | 2.5 | 20.0 | 6370 | 3660 |
| 1157 | 63.0 | 20.2 | 6.8 | 10.0 | 164 | 5230 |
| 1158 | 79.7 | 17.2 | 0.1 | 3.0 | 1940 | 3850 |
| 1159 | 94.6 | 5 | 0.1 | 0.3 | $3.2 \times 10^5$ | 4380 |
| 1160 | 55.0 | 25.0 | 10.0 | 10.0 | 87.4 | 3070 |
| 1401* | 83.3 | 0 | 13.7 | 3.0 | 411 | 3130 |
| 1501* | 79.5 | 17.5 | 0 | 3.0 | 2320 | 3870 |

(A star mark represents a referential sample for comparison, which is out of the scope of the present invention.)

Samples 1101, 1401, and 1501 are of ternary system and have resistances all lying within the value range acceptable for practical use. However, as can be seen from Table 3, these samples do not satisfy the requirements for the objective thermistors of the present invention, i.e., the requirements including relatively low resistance, relatively high B-constant, and in addition a smaller dependence of resistivity on the sintering temperature. Consequently, these have been regarded as being out of the scope of the present invention. Sample 1101 has obviously a composition of the prior art.

TABLE 3

| Sample No. | Composition of sample (atomic %) Mn | Ni | Cu | Zr | Resistivity ρ25° C. (Ω cm) | B-constant (°K) | Sintering temperature (°C.) |
|---|---|---|---|---|---|---|---|
| | | | | | 591 | 3750 | 1150 |
| 1101* | 80 | 17.5 | 2.5 | 0 | 820 | 3900 | 1100 |
| | | | | | 1090 | 3870 | 1050 |
| | | | | | 630 | 3850 | 1150 |
| 1151 | 79.8 | 17.5 | 2.5 | 0.3 | 825 | 3880 | 1100 |
| | | | | | 1110 | 3900 | 1050 |
| | | | | | 674 | 3980 | 1150 |
| 1154 | 77.3 | 15.5 | 2.5 | 3.0 | 840 | 4030 | 1100 |
| | | | | | 1170 | 4050 | 1050 |
| | | | | | 297 | 3000 | 1150 |
| 1401* | 83.3 | 0 | 13.7 | 3.0 | 411 | 3130 | 1100 |
| | | | | | 466 | 3140 | 1050 |
| | | | | | 2320 | 3800 | 1150 |
| 1501* | 79.5 | 17.5 | 0 | 3.0 | 2840 | 3920 | 1100 |
| | | | | | 4130 | 3940 | 1050 |

All the samples included within the scope of the present invention have properties lying within the range of characteristic values required for practical use. They show the characteristics of low resistance coupled with high B-constant which are the effects brought about by the addition of zirconium and through the adjustment of resistivity by the addition of copper. The percentages of resistance deviation thereof after 1000 hours' continuous load aging in the high humidity (95% RH at 40° C.) under an application of a d.c. voltage (10 V/mm) are within the range of ±5%, and those after 3000 hours' continuous load aging at the temperature of 150° C. in the air under an application of a d.c. voltage (10 V/mm) are also within the range of ±5%. This indicates that these samples can be put to practical use with satisfaction.

In the preparation of the above samples, agate balls were used for mixing the raw materials and for mixing and grinding the calcined materials. The results of elementary analysis on the above samples (sintered mass) showed that in every sample the total content of the contaminating, glass forming elements such as silicon and boron was not more than 1 atomic % per 100 atomic % of the thermistor-constituting elements. Subsequently, the composition of sample 1154 was selected out, blended with powdered silica to give Si contents of 1 and 2 atomic % per 100 atomic % of the thermistor-constituting elements, and processed in the same way and under the same conditions as used in preparing the above samples, to prepare two kinds of thermistor samples. As a result, the thermistor containing 1 atomic % of Si showed a ρ25° C. value of 852 Ωcm and a B-constant of 4040° K., which are almost the same as those of sample 1154, whereas the thermistor containing 2 atomic % of Si showd a ρ25° C. value of 1500 Ωcm and a B-constant of 4050° K. In the latter sample, only the ρ25° C. is much higher (roughly twice) in comparison with sample 1154, which is undesirable for the objective thermistors of the present invention.

TABLE 4

| Sample No. | Composition of sample (atomic %) Mn | Ni | Fe | Cr | Zr | ρ 25° C. (Ωcm) | B (°K.) | Percentage of resistance deviation with time (%) |
|---|---|---|---|---|---|---|---|---|
| 2001* | 80 | 17.5 | 2.5 | 0 | 0 | 3200 | 4000 | +4.5 |
| 2002* | 80 | 17.5 | 0 | 2.5 | 0 | 2950 | 4000 | +2.1 |
| 2003* | 80 | 17.5 | 0 | 0 | 2.5 | 2200 | 3840 | +4.8 |
| 2004 | 82.4 | 17.0 | 0.3 | 0 | 0.3 | 3400 | 4090 | +1.8 |
| 2005 | 75.5 | 16.0 | 2.5 | 0 | 5 | 3500 | 4000 | ±1.2 |
| 2006 | 94.4 | 5.0 | 0.3 | 0 | 0.3 | $9.6 \times 10^5$ | 4800 | +2.0 |
| 2007 | 55 | 30 | 0 | 5 | 10 | 7200 | 4120 | +1.9 |
| 2008 | 69.7 | 20 | 0 | 0.3 | 10 | 2800 | 3890 | +0.8 |
| 2009 | 86.0 | 10.0 | 0 | 4.0 | 10 | $4.7 \times 10^4$ | 4430 | +1.7 |
| 2010 | 85.7 | 8.0 | 0.3 | 1.0 | 5 | $2.3 \times 10^4$ | 4200 | +2.1 |
| 2011 | 64 | 16 | 5 | 5 | 10 | $3.4 \times 10^5$ | 4570 | +2.0 |
| 2012 | 81.2 | 17.5 | 0.5 | 0.5 | 0.3 | 2300 | 4020 | +0.8 |

(A star mark represents a referential sample for comparison, which is out of the scope of the present invention.)

Samples 2001, 2002, and 2003, which are shown for comparison, have large percentages of the time-dependent resistance deviation, lacking in the stability necessary for practical use. Samples 2004 to 2012 showed a high stability, which is an object of the present invention, due to the effect of Fe or Cr and of Zr, i.e., the percentages of resistance deviation thereof after 3000 hours' load aging under the above-mentioned conditions were within the range of ±2%. In addition, these samples have properties lying within the range of electrical characteristic values required for practical use. Thus, these samples can be put to practical use with satisfaction.

TABLE 5

| Sample No. | Composition of sample (atomic %) Mn | Ni | Cu | Fe | Li | ρ25° C. (Ω . cm) | B [°K] |
|---|---|---|---|---|---|---|---|
| 101* | 80 | 17.5 | 2.5 | 0 | 0 | 820 | 3900 |
| 102* | 79.97 | 17.5 | 2.5 | 0 | 0.03 | 810 | 3900 |
| 103 | 79.9 | 17.5 | 2.5 | 0 | 0.1 | 800 | 3950 |
| 104 | 79.8 | 17.4 | 2.5 | 0 | 0.3 | 780 | 4000 |
| 105 | 79.2 | 17.3 | 2.5 | 0 | 1.0 | 750 | 4050 |
| 106 | 77.6 | 17.0 | 2.4 | 0 | 3.0 | 700 | 4150 |
| 107 | 72.0 | 15.8 | 2.2 | 0 | 10.0 | 710 | 4300 |
| 108 | 68.0 | 14.9 | 2.1 | 0 | 15.0 | 780 | 4550 |
| 109 | 64.0 | 14.0 | 2.0 | 0 | 20.0 | 890 | 4700 |
| 110* | 60.0 | 13.1 | 1.9 | 0 | 25.0 | 1130 | 4700 |
| 121* | 94.3 | 5.6 | 0.1 | 0 | 0 | $1.2 \times 10^6$ | 4650 |
| 122 | 84.9 | 5.0 | 0.1 | 0 | 10 | 51000 | 4700 |
| 123* | 66.7 | 27.8 | 5.5 | 0 | 0 | 4.5 | 1500 |
| 124 | 60 | 25.0 | 5.0 | 0 | 10 | 120 | 3850 |
| 125 | 50 | 25.0 | 5.0 | 0 | 20 | 38 | 2900 |
| 126 | 94.8 | 5.0 | 0.1 | 0 | 0.1 | $8.0 \times 10^5$ | 4700 |
| 201* | 80 | 17.5 | 0 | 2.5 | 0 | 3200 | 4000 |
| 202 | 79.9 | 17.5 | 0 | 2.5 | 0.1 | 3000 | 4050 |
| 203 | 79.2 | 17.3 | 0 | 2.5 | 1.0 | 2900 | 4250 |
| 204 | 72.0 | 15.8 | 0 | 2.2 | 10.0 | 2600 | 4600 |
| 205 | 64.0 | 14.0 | 0 | 2.0 | 20.0 | 3500 | 4750 |
| 206* | 60.0 | 13.1 | 0 | 1.9 | 25.0 | 4400 | 4750 |
| 211* | 94.9 | 5.0 | 0 | 0.1 | 0 | $1.4 \times 10^6$ | 4800 |
| 212 | 94.8 | 5.0 | 0 | 0.1 | 0.1 | $9.2 \times 10^5$ | 5000 |
| 213 | 50.0 | 25.0 | 0 | 5.0 | 20 | 41 | 3000 |
| 214* | 44.0 | 30.0 | 0 | 6.0 | 20 | 5.1 | 1600 |
| 301* | 78.5 | 17.5 | 3.0 | 1.0 | 0 | 550 | 3600 |
| 302 | 78.4 | 17.5 | 3.0 | 1.0 | 0.1 | 510 | 3650 |
| 303 | 77.7 | 17.3 | 3.0 | 1.0 | 1.0 | 480 | 3750 |
| 304 | 70.6 | 15.8 | 2.7 | 0.9 | 10.0 | 430 | 4000 |
| 305 | 62.8 | 14.0 | 2.4 | 0.8 | 20 | 590 | 4350 |
| 306* | 58.9 | 13.1 | 2.3 | 0.8 | 25 | 730 | 4300 |
| 311 | 71.6 | 15.8 | 2.2 | 0.4 | 10.0 | 630 | 4250 |
| 312 | 71.2 | 15.8 | 2.2 | 0.8 | 10.0 | 480 | 4200 |
| 313 | 70.4 | 15.8 | 2.2 | 1.6 | 10.0 | 500 | 4250 |
| 314 | 69.6 | 15.8 | 2.2 | 2.4 | 10.0 | 620 | 4250 |

(The star mark represents a referential sample for comparison, which is out of the scope of the present invention.)

Samples 3121 and 3211 showed ρ25° C. values not smaller than 1 M Ω.cm, being out of the range of the practically appreciable values. Samples 3123 and 3214 showed ρ25° C. values not larger than 10 Ωcm, being also out of the range of the practically appreciable values. These have obviously compositions of the prior art. Samples 3101, 3201, and 3301, though exhibiting practically useful resistivity values, have compositions of the prior art. Samples 3110, 3206, and 3306, though having practically useful resistivity values, showed no effect given by the added Li, i.e. the low resistivity coupled with high B-constant characteristics, which are intended by the present invention, and these samples, wherein Li content is over 20 atomic %, are inferior in a stability of resistivity in load aging at a high humidity under an application of a d.c. voltage. From these respects, these samples have been regarded as being out of the scope of the present invention. Showing no effect given by the added Li, sample 3102 has also been regarded as being out of the scope. Meanwhile, the samples of the present invention all have properties lying within the range of practically appreciable characteristic values. They showed the effect given by the added Li and the effect of giving the characteristics of low resistivity coupled with high B-constant. The percentages of resistance deviation thereof after 3000 hours' continuous load aging at the high humidity (95% RH at 40° C.) under an application of a d.c. voltage (10 V/mm) were within ±5%, and the percentages of resistance deviation thereof after 3000 hours' continuous load aging at the temperature of 150° C. in the air under an application of a d.c. voltage (10 V/mm) were also within ±5%. Consequently, these samples can be put to practical use with satisfaction.

In the preparation of the above samples, agate balls were used for mixing the raw materials and for mixing and grinding the calcined materials. The results of elementary analysis on the above samples (sintered mass) showed that in every sample the total content of the contaminating, glass forming elements such as silicon and boron was not more than 1 atomic % per 100 atomic % of the thermistor-constituting elements. Subsequently, the composition of sample 3107 was selected out, blended with powdered silica to give Si contents of 1 and 2 atomic % per 100 atomic % of the thermistor-constituting elements, and processed in the same way and under the same conditions as used in preparing the above samples, to prepare two kinds of thermistor samples. As a result, the thermistor containing 1 atomic % of Si showed a ρ25° C. value of 730 Ωcm and a B-constant of 4300° K., which are almost the same as those of sample 3107, whereas the thermistor containing 2 atomic % of Si showed a ρ25° C. value of 1500 Ωcm and a B-constant of 4350° K. In the latter sample, in comparison with sample 3107, the ρ25° C. is much higher (roughly twice) for the value of B-constant, which is undesirable for the objective thermistor of this invention.

As can be seen from the foregoing description, this invention can provide oxide thermistor compositions of low resistance coupled with high B-constant.

What is claimed is:

1. Oxide thermistor composition consisting essentially of metal oxide, wherein said metal consists essentially of 94.6 to 30 atomic % of Mn ion, 5 to 30 atomic % of Ni ion, 0.1 to 15 atomic % of at least one kind of ion selected from the group consisting of Cu and Fe, and 0.3 to 40 atomic % of Cr ion.

2. Oxide thermistor composition consisting essentially of metal oxide, wherein said metal consists essentially of 94.8 to 50 atomic % of Mn ion, 5 to 25 atomic % of Ni ion, 0.1 to 5 atomic % of at least one kind of ion selected from the group consisting of Cu and Fe, and 0.1 to 20 atomic % of Li ion.

3. Oxide thermistor composition consisting essentially of metal oxide, wherein said metal consists essentially of 94.6 to 55 atomic % of Mn ion, 5 to 25 atomic % of Ni ion, 0.1 to 10 atomic % of Cu ion, and 0.3 to 10 atomic % of Zr ion.

4. Oxide thermistor composition consisting essentially of metal oxide, wherein said metal consists essentially of 94.4 to 55 atomic % of Mn ion, 5 to 30 atomic % of Ni ion, 0.3 to 5 atomic % of at least one kind of ion selected from the group consisting of Fe and Cr, and 0.3 to 10 atomic % of Zr ion.

5. Oxide thermistor composition as claimed in claim 1, 2, 3 or 4, which further consists essentially of a binder of less than 1 atomic % of at least one kind of cation selected from the group consisting of Si and B.

* * * * *